US005224868A

United States Patent [19]

Tseng

[11] Patent Number: 5,224,868

[45] Date of Patent: Jul. 6, 1993

[54] TELEPHONE CONNECTING SOCKET

[76] Inventor: Cheng-Chung Tseng, No. 61, Lane 66, Section 3, Chang Jung Road, Tainan, Taiwan

[21] Appl. No.: 992,330

[22] Filed: Dec. 21, 1992

[51] Int. Cl.[5] ..... H01R 4/50; H01R 13/44

[52] U.S. Cl. ..... 439/136; 439/344; 439/536; 439/676; 439/892; 439/367; 439/373

[58] Field of Search ..... 439/136-138, 439/142-145, 147, 344, 367, 373, 536, 676, 892, 893

[56] References Cited

U.S. PATENT DOCUMENTS 4,790,769 12/1988 Kanada ..... 439/536
4,887,972 12/1989 McLean et al. ..... 439/893
4,993,962 2/1991 Noda et al. ..... 439/136
5,161,988 11/1992 Krupka ..... 439/136

*Primary Examiner*—Paula A. Bradley
*Attorney, Agent, or Firm*—Morton J. Rosenberg; David I. Klein

[57] ABSTRACT

A telephone connecting socket to be fixed in a wall for a connecting plug of a telephone to fit in a hole in the socket having a front cap, a body and a rear cap, the front cap covering a front portion of the body and the rear cap covering a rear half portion of the body, the front cap having an opening normally closed up with a shield elastically pushed by a coil spring, the body having an inner socket with a hole for the connecting plug of a telephone to fit therein by passing through the opening in the front cap with the shield pushed open.

2 Claims, 4 Drawing Sheets

TELEPHONE CONNECTING SOCKET

BACKGROUND OF THE INVENTION

As a conventional art for connecting a telephone with telephone wires from a telephone company, a telephone connecting socket is used near a place a telephone is to be set.

However, a conventional telephone connecting socket and its wiring methods has disadvantages as follows.

1. Indoor telephone wires are mostly not hidden, liable to be broken by external force in long period of use.

2. Unhidden indoor telephone wires impair outward appearance of a room.

Another conventional art of connecting a telephone with a telephone wires is to use a tube 7 buried in a wall to contain telephone wires 8 therein, and several connecting sockets 9 fixed in a wall as shown in FIG. 4 for connecting a telephone 10 or several telephones, as an improvement of the above-mentioned art. Nevertheless, this art has following drawbacks.

1. Receiving holes 91 in the connecting socket 9 for a connecting plug of a telephone has no protective cap, so insects such as ants, cockroaches and dirt can go therein to make damage to wires or contact points.

2. If unused connecting sockets have one of their terminal pins 911 carelessly being made wet, the whole wire lines can be short-circuited, making the telephone temporarily useless.

3. Excessive connecting sockets give negative effect to the outlook of a room.

SUMMARY OF THE INVENTION

A telephone connecting socket in the present invention has been planned to have features as follows.

1. It has a shield to close up a hole for receiving a connecting plug of a telephone so as to protect terminal pins in an inner socket from various insects such as ants, cockroaches, and dirt to go therein impairing transmitting function.

2. It has a rear cap covering a rear half portion of tis body, protecting wires therein from being broken during fixing and wiring process of the socket.

BRIEF DESCRIPTION OF DRAWINGS

The invention will be better understood by reference to the accompanying drawings, wherein.

DETAILED DESCRIPTION OF THE INVENTION

Figure 1:
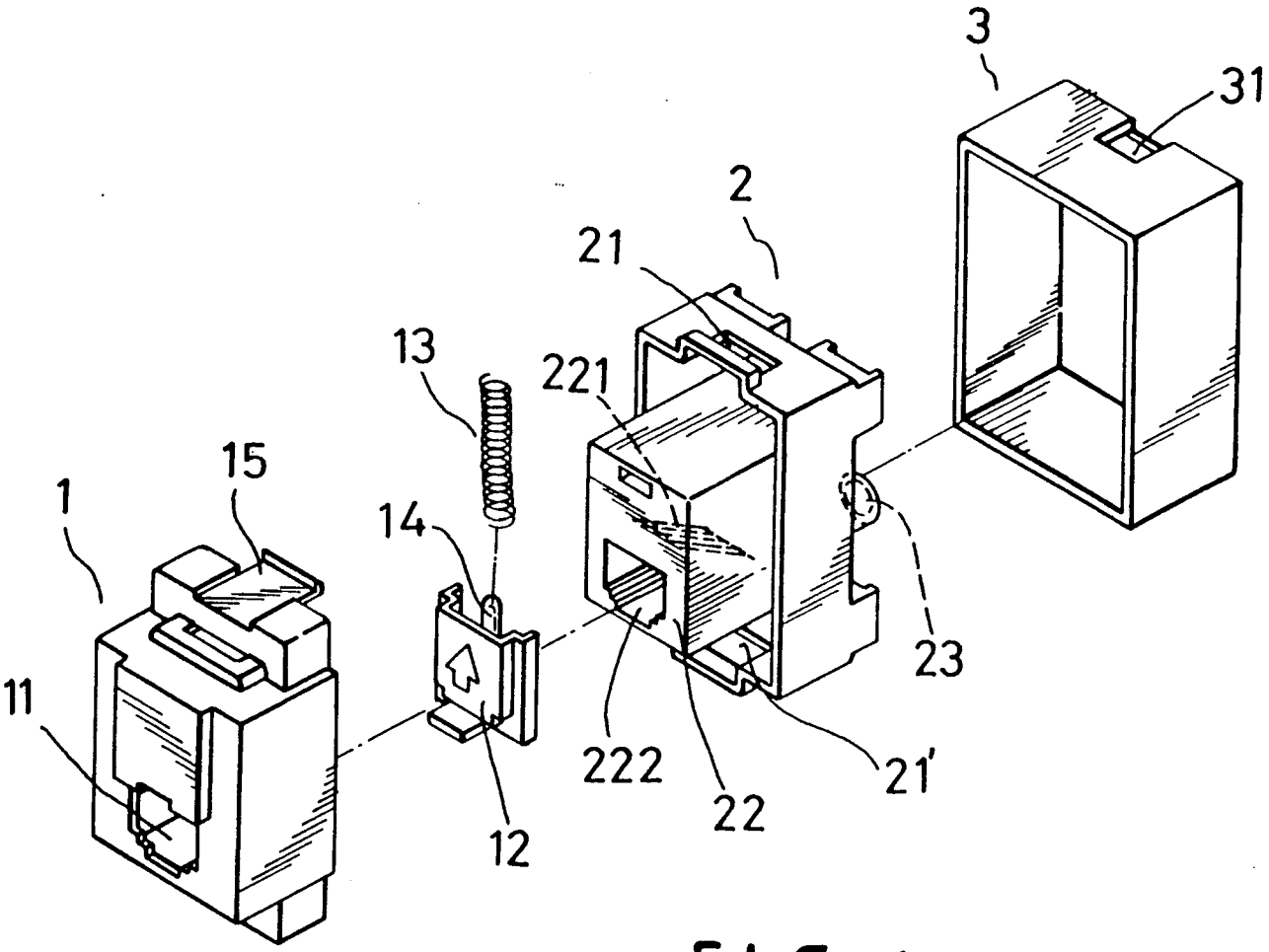
FIG. 1 is an exploded perspective view of a telephone connecting socket in the present invention.
Figure 2:
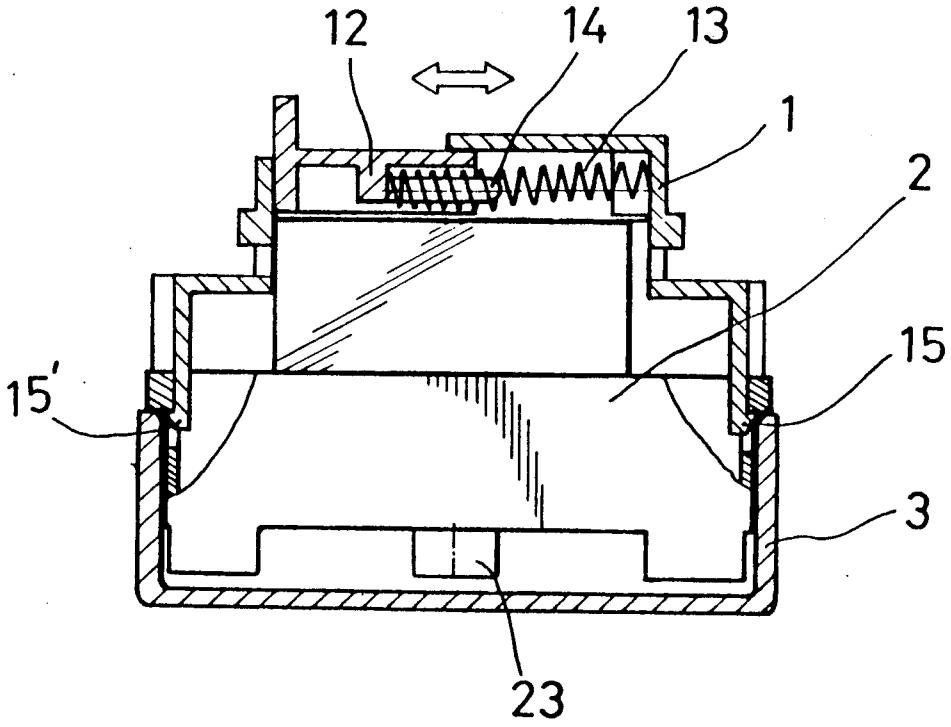
FIG. 2 is a cross-sectional view of the telephone connecting socket in the present invention, showning how a shield (12) is to be moved open.
Figure 3:
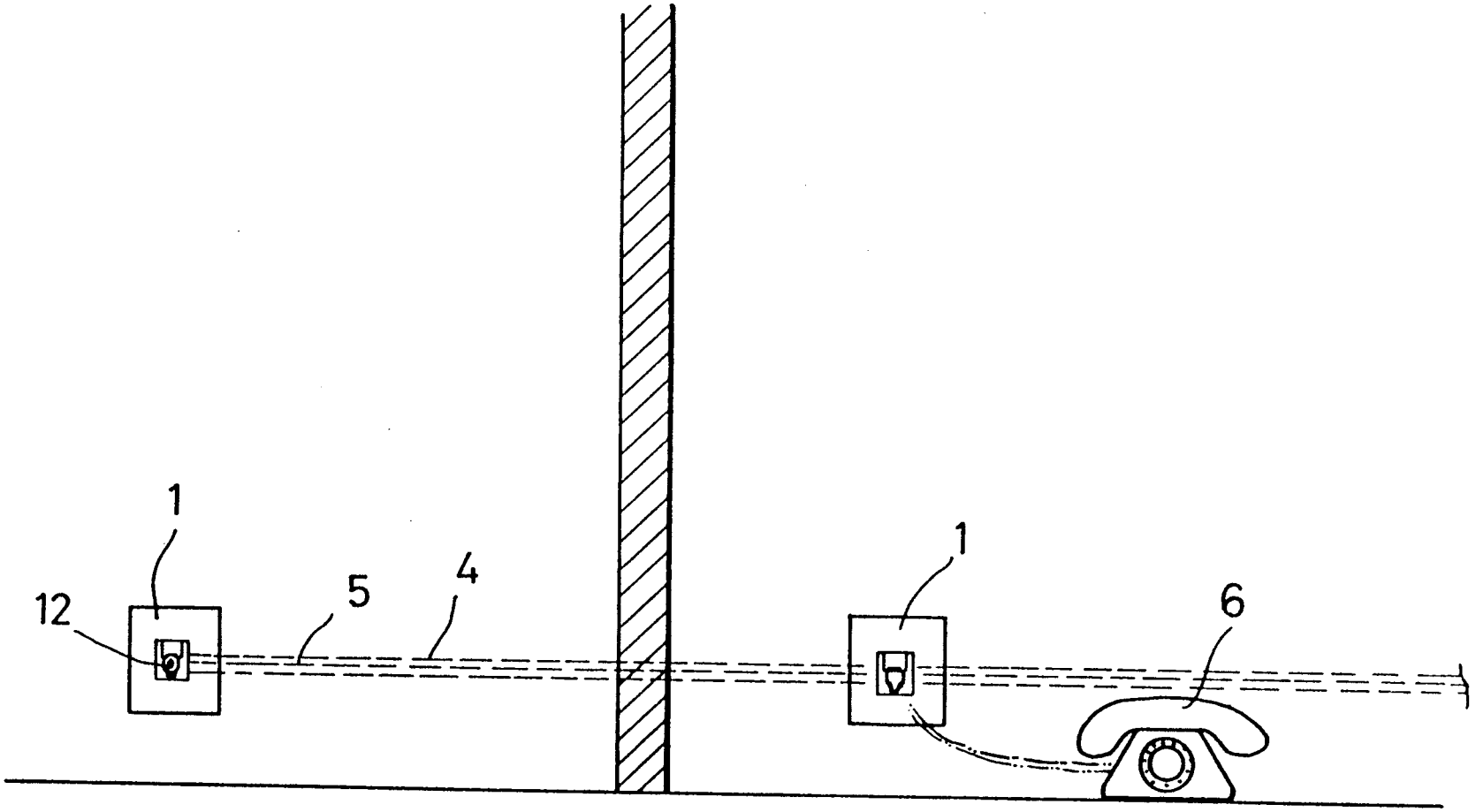
FIG. 3 is a diagram of the telephone connecting sockets connected with telephone wires in a wall in the present invention; and, FIG. 4 is a diagram of conventional telephone connecting sockets.
Figure 4:
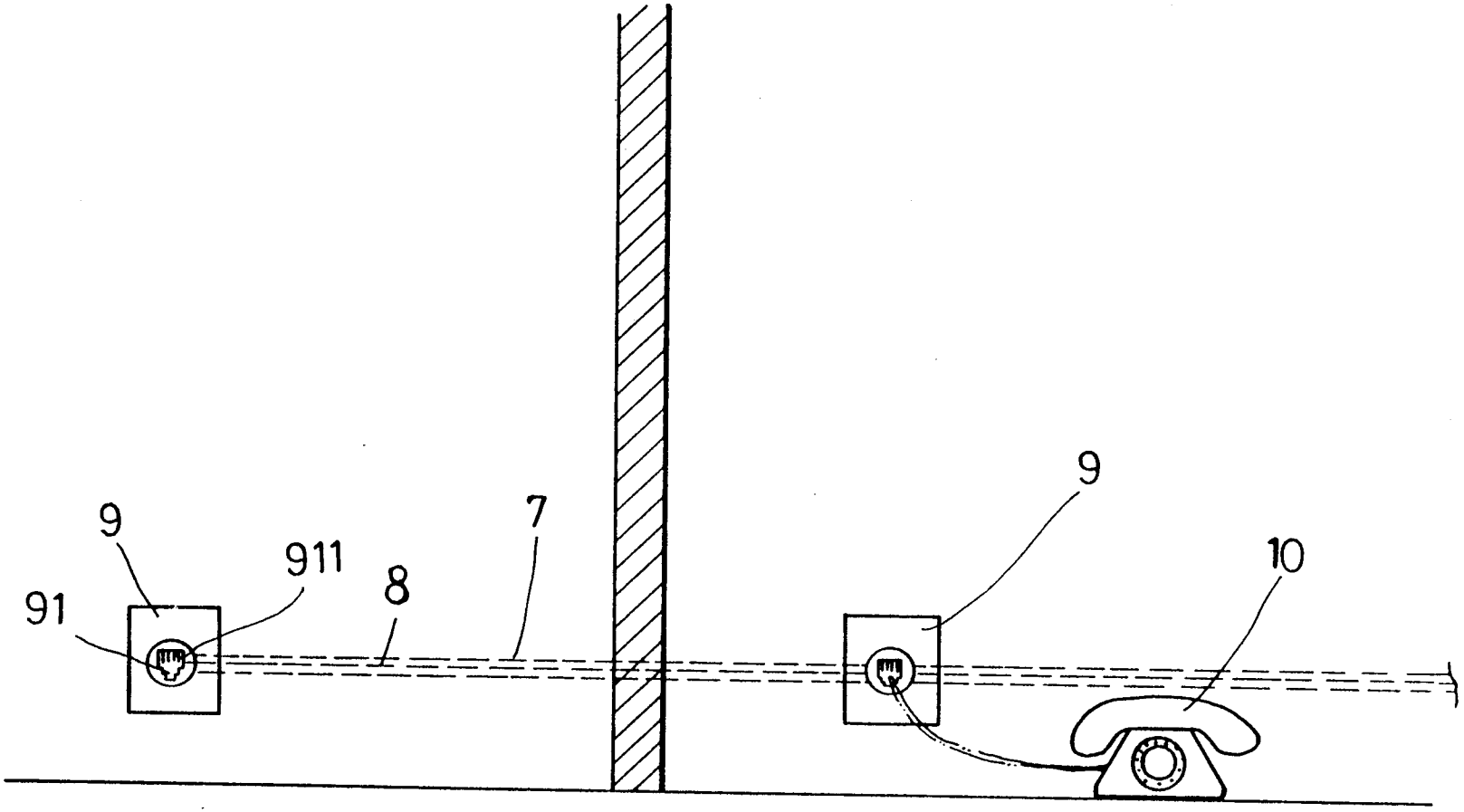
FIG. 4 (PRIOR ART)

A telephone connecting socket in the present invention as shown in FIG. 1, comprises a front cap 1, a body 2 and a rear cap 3 combined together.

The front cap 1 shaped as a square case has an opening 11 in a front side to be closed up by a shield 12 thereon, which is adapted to move under the front side wall to close or open the opening 11, elastically pushed by a coil spring 13 fitting around a locating bar 14 of the shield 12. The coil spring 13 has an end resting on an inner side wall of the front cap 1 and the other end resting on a down projection of the shield 12 so that the shield 12 can normally close the opening 11 by means of the elasticity of the coil spring 13 and be manually pushed to open the opening 11. Two tenons 15, 15' are provided on two opposite sides—the upper and the lower—of the front cap 1 to engage in two holes 21, 21' of the body 2 to combine the front cap 1 together with the body 2.

The body 2 has an inner socket 22 provided with terminal pins 221 and an opening 222 for the connecting plug of a telephone to fit therein through the opening 11 of the front cap 1 with the shield 12 pushed open, and a through hole 23 in its bottom.

The rear cap 3 is shaped as a square case with an open side to fit around the lower half portion of the body 2, having a hole 31 near its bottom in one side for telephone wires 5 to pass through to be connected with the terminal pins 221.

The telephone connecting sockets are fixed in a wall of a house, being connected with one another with wires 5 contained in a protective tube 4. The telephone wires 5 pass through the holes 31 in the rear cap 3, connected with the terminal pins 221. The rear cap 3, protects the telephone wires 5 in the bottom of the body 2 from being broken by external force during fixing process in the wall. The through holes 23 in the body 2 is preserved for a wires such as of a door telephone to be added later, and the shield 12 is pushed by elastic spring 13 to protect the opening 222 of the inner socket 22.

While the preferred embodiments of the invention have been described above, it will be recognized and understood that various modifications may be made therein and the appended claims are intended to cover all such modifications which may fall within the spirit and scope of the invention.

What is claimed is:

1. A telephone connecting socket to be fixed in an outlet hole of telephone wires hidden in a wall comprising:

a front cap being shaped as a square case, having an opening in a front side and two tenons extending down from two opposite sides, a shield having a locating member extending from a bottom projection to the right, a coil spring fitting around the locating member and being put between the bottom projection and an inner wall of a side to elastically push the shield to close up the opening of the front cap;

a body being shaped as a square case having two holes in two opposite sides for the tenons of the front cap to engage to combine the body with the front cap, an inner socked provided with a hole in a front side for a connecting plug of a telephone to fit therein and corresponding to the opening of the front cap, and terminal pins at a bottom of the hole;

a rear cap shaped as a square case with an open side, fitting around the rear half portion of the body, having a hole inside near its bottom;

said rear cap protecting telephone wires in this socket from being broken by external force, said shield closing the opening of the front cap and the opening of the inner socket when this socket is not used for connecting a telephone.

2. The telephone connecting socket as claimed in claim 1, wherein said body has a through hole in its bottom.

* * * * *